US012379120B2

(12) United States Patent
Kuroda et al.

(10) Patent No.: US 12,379,120 B2
(45) Date of Patent: Aug. 5, 2025

(54) AIR CONDITIONER CONTROL SYSTEM, SERVER APPARATUS AND AIR CONDITIONER CONTROL METHOD

(71) Applicant: DAIKIN INDUSTRIES, LTD., Osaka (JP)

(72) Inventors: Kohei Kuroda, Osaka (JP); Takashi Hasegawa, Osaka (JP)

(73) Assignee: DAIKIN INDUSTRIES. LTD., Osaka (JP)

( * ) Notice: Subject to any disclaimer, the term of this patent is extended or adjusted under 35 U.S.C. 154(b) by 123 days.

(21) Appl. No.: 18/254,017

(22) PCT Filed: Nov. 16, 2021

(86) PCT No.: PCT/JP2021/042042
§ 371 (c)(1),
(2) Date: May 23, 2023

(87) PCT Pub. No.: WO2022/118649
PCT Pub. Date: Jun. 9, 2022

(65) Prior Publication Data

US 2023/0417436 A1 Dec. 28, 2023

(30) Foreign Application Priority Data

Dec. 1, 2020 (JP) ..... 2020-199820

(51) Int. Cl.
*F24F 11/38* (2018.01)

(52) U.S. Cl.
CPC ..... *F24F 11/38* (2018.01)

(58) Field of Classification Search
CPC .. F24F 11/38; F24F 11/30; F24F 11/32; F24F 11/37; F24F 11/49
See application file for complete search history.

(56) References Cited

U.S. PATENT DOCUMENTS

2003/0140275 A1 7/2003 Imada
2015/0159931 A1* 6/2015 Okada ..... F24F 11/83 62/126

(Continued)

FOREIGN PATENT DOCUMENTS

CN 109612025 4/2019
EP 3001114 3/2016

(Continued)

OTHER PUBLICATIONS

International Preliminary Report on Patentability for PCT/JP2021/042042 mailed on Jun. 15, 2023.

(Continued)

*Primary Examiner* — Marc E Norman
(74) *Attorney, Agent, or Firm* — IPUSA, PLLC

(57) ABSTRACT

An air conditioner control system, a server apparatus, and an air conditioner control method that ensure the safety of a worker when an emergency operation is started. An air conditioner control system includes an air conditioner; a server apparatus communicably connected to the air conditioner; and a control unit configured to transmit setting information for an emergency operation to the air conditioner after instructing to stop operation of all indoor units of the air conditioner, in response to receiving a report indicating malfunction from the air conditioner.

5 Claims, 7 Drawing Sheets

(56) References Cited

U.S. PATENT DOCUMENTS

| | | | | |
|---|---|---|---|---|
| 2015/0211779 | A1* | 7/2015 | Brandt | F25D 21/006 62/80 |
| 2022/0003463 | A1* | 1/2022 | Takegami | F25B 9/008 |
| 2022/0146131 | A1* | 5/2022 | Nakayama | F24F 11/46 |
| 2022/0342411 | A1* | 10/2022 | Hirose | F24F 11/64 |
| 2022/0397299 | A1* | 12/2022 | Pouchak | G05B 19/0428 |

FOREIGN PATENT DOCUMENTS

| | | |
|---|---|---|
| JP | 2001-357151 | 12/2001 |
| JP | 2004-069080 | 3/2004 |
| JP | 2004-077078 | 3/2004 |
| JP | 2006-125647 | 5/2006 |
| JP | 2016-111540 | 6/2016 |
| WO | 2015/192073 | 12/2015 |

OTHER PUBLICATIONS

International Search Report for PCT/JP2021/042042 mailed on Feb. 1, 2022.

Extended European search report mailed on Apr. 25, 2024 with respect to the corresponding European patent application No. 21900404.1.

* cited by examiner

AIR CONDITIONER CONTROL SYSTEM, SERVER APPARATUS AND AIR CONDITIONER CONTROL METHOD

TECHNICAL FIELD

The present disclosure relates to an air conditioner control system, a server apparatus, and an air conditioner control method.

BACKGROUND ART

There is a known air conditioner control system in which an air conditioner and a server apparatus are connected via a public line such as the Internet to control the air conditioner remotely. According to the air conditioner control system, for example, when a malfunction occurs in the air conditioner, an emergency operation can be started remotely.

CITATION LIST

Patent Documents

Patent Document 1

(Patent document 1) Japanese Unexamined Patent Application Publication No. 2006-125647
(Patent document 2) Japanese Unexamined Patent Application Publication No. 2004-077078
(Patent document 3) Japanese Unexamined Patent Application Publication No. 2004-069080

SUMMARY OF INVENTION

Technical Problem

On the other hand, in the case of the above air conditioner control system, an emergency operation may be unintentionally started remotely when a worker is performing an operation on the site in response to the occurrence of an air conditioner malfunction.

The present disclosure provides an air conditioner control system, a server apparatus, and an air conditioner control method that ensure the safety of the worker when an emergency operation is started.

Solution to Problem

An air conditioner control system according to a first aspect of present disclosure includes an air conditioner;

a server apparatus communicably connected to the air conditioner; and a control unit configured to transmit setting information for an emergency operation to the air conditioner after instructing to stop operation of all indoor units of the air conditioner, in response to receiving a report indicating malfunction from the air conditioner.

According to the first aspect of the disclosure, even when the setting information for an emergency operation is activated in the air conditioner, the emergency operation is not immediately started, but only when the remote controller of the indoor unit is operated, the emergency operation is started. That is, it is possible to avoid a situation where an emergency operation is inadvertently started. Thus, according to the first aspect of the present disclosure, an air conditioner control system that ensures the safety of the worker when an emergency operation is started can be provided.

Further, a second aspect of the present disclosure is the air conditioner control system described in the first aspect, wherein the control unit reports that the setting information for the emergency operation has been successfully set, in response to receiving a report indicating that setting of the setting information has been completed from the air conditioner.

Further, a third aspect of the present disclosure is the air conditioner control system described in the first aspect, wherein the control unit instructs to stop operation of all of the indoor units of the air conditioner and instructs the air conditioner to stop the emergency operation, in response to receiving maintenance information from the air conditioner before the emergency operation based on the setting information continues for a predetermined time period.

Further, a fourth aspect of the present disclosure is the air conditioner control system described in the third aspect, wherein the air conditioner includes at least multiple outdoor units, and the emergency operation is performed by an outdoor unit other than an outdoor unit in which the malfunction has occurred among the multiple outdoor units.

Further, a server apparatus according to a fifth aspect of present disclosure is a server apparatus communicably connected to an air conditioner, the server apparatus including:

a control unit configured to transmit setting information for an emergency operation to the air conditioner after instructing to stop operation of all indoor units of the air conditioner, in response to receiving a report indicating malfunction from the air conditioner.

According to the fifth aspect of the disclosure, even when the setting information for an emergency operation is activated in the air conditioner, the emergency operation is not immediately started, but only when the remote controller of the indoor unit is operated, the emergency operation is started. That is, it is possible to avoid a situation where an emergency operation is inadvertently started. Thus, according to the fifth aspect of the present disclosure, a server apparatus that ensures the safety of the worker when an emergency operation is started can be provided.

Further, an air conditioner control method according to a sixth aspect of present disclosure is an air conditioner control method performed in an air conditioner control system including an air conditioner and a server apparatus communicably connected to the air conditioner, the air conditioner control method including:

a control step of transmitting setting information for an emergency operation to the air conditioner after instructing to stop operation of all indoor units of the air conditioner, in response to receiving a report indicating malfunction from the air conditioner.

According to the sixth aspect of the disclosure, even when the setting information for an emergency operation is activated in the air conditioner, the emergency operation is not immediately started, but only when the remote controller of the indoor unit is operated, the emergency operation is started. That is, it is possible to avoid a situation where an emergency operation is inadvertently started. Thus, according to the sixth aspect of the present disclosure, an air conditioner control method that ensures the safety of the worker when an emergency operation is started can be provided.

DESCRIPTION OF EMBODIMENTS

Figure 1:
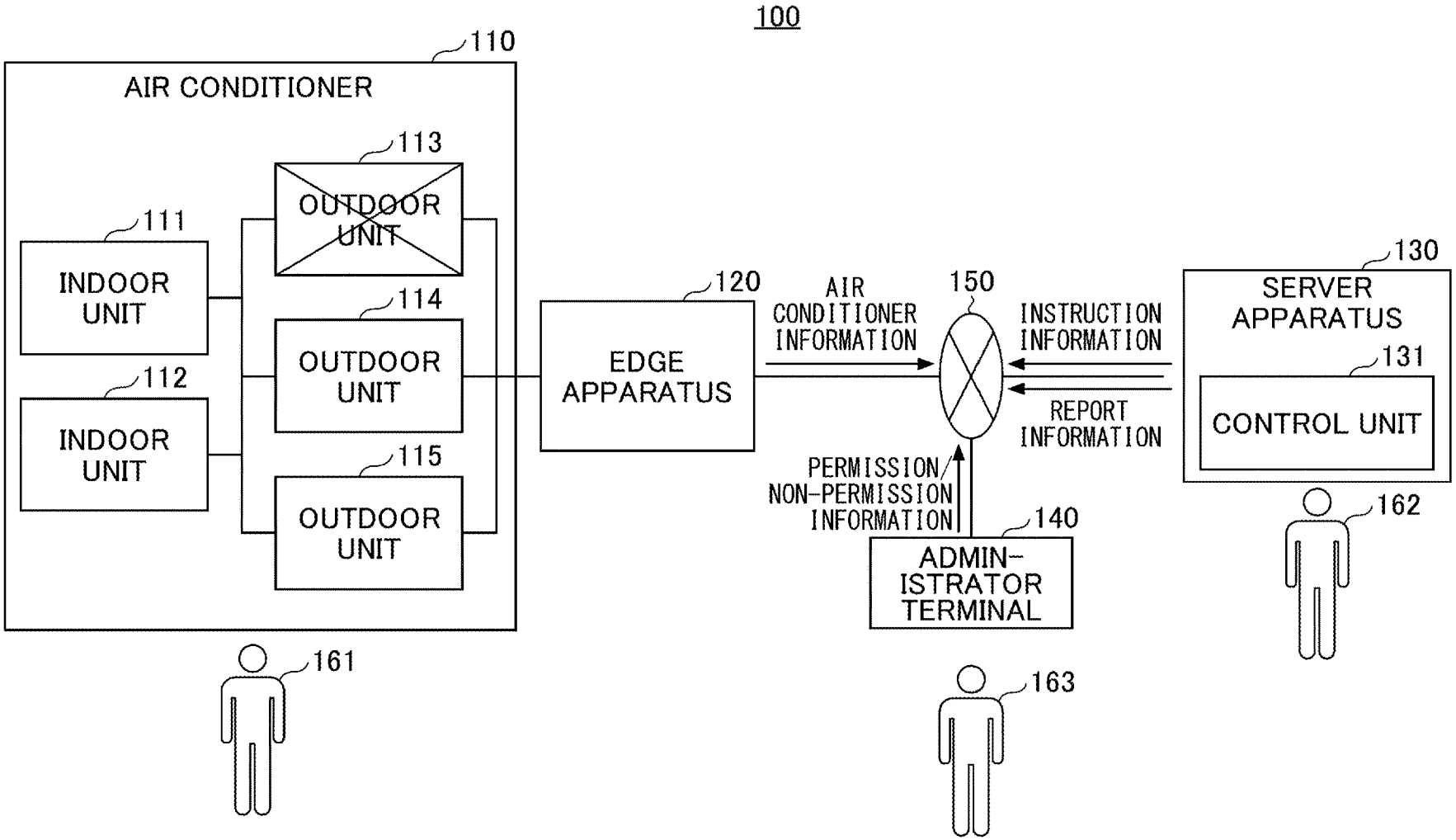
FIG. 1 illustrates an example of the system configuration of an air conditioner control system.

Each embodiment will be described below with reference to the accompanying drawings. In the present specification and drawings, with respect to elements having substantially the same functional configuration, duplicate descriptions are omitted by applying identical reference numerals.

First Embodiment

<System Configuration of Air Conditioner Control System>

First, the system configuration of the air conditioner control system is described. FIG. 1 illustrates an example of the system configuration of the air conditioner control system.

As illustrated in FIG. 1, an air conditioner control system 100 includes an air conditioner 110, an edge apparatus 120, a server apparatus 130, and an administrator terminal 140. In the air conditioner control system 100, the air conditioner 110 and the edge apparatus 120 are communicably connected via an exclusive-use communication line. Further, the edge apparatus 120 and the server apparatus 130, and the administrator terminal 140 and the server apparatus 130, are respectively communicatively connected via a public line such as the Internet 150.

The air conditioner 110 includes indoor units 111 and 112 and outdoor units 113, 114, and 115. The number of indoor units and outdoor units illustrated in FIG. 1 is an example, and the air conditioner 110 in the present embodiment has multiple indoor units and multiple outdoor units and is configured to allow an emergency operation.

The example in FIG. 1 illustrates that when a malfunction occurs in the outdoor unit 113 that is a parent unit, the remaining two outdoor units 114 and 115 that are child units, excluding the aforementioned outdoor unit 113 (one of the outdoor units where the malfunction has occurred), cooperate with each other to perform an emergency operation.

The edge apparatus 120 transmits air conditioner information output by the air conditioner 110 to the server apparatus 130 via the Internet 150. The air conditioner information output by the air conditioner 110 includes, for example, malfunction information (report) indicating that a malfunction has occurred and information indicating the state of the air conditioner 110 during an emergency operation. Further, the air conditioner information output by the air conditioner 110 includes information (maintenance information) indicating that maintenance work has been performed by a worker 161 performing maintenance on the air conditioner 110.

Further, the edge apparatus 120 also transmits instruction information transmitted from the server apparatus 130 via the Internet 150 to the air conditioner 110. The instruction information transmitted by the server apparatus 130 to the edge apparatus 120 includes, for example, information instructing to stop operation of all indoor units, information instructing to set an emergency operation, information instructing to stop the emergency operation, etc.

A control program is installed in the server apparatus 130, and when the program is executed, the server apparatus 130 functions as a control unit 131.

The control unit 131 controls the air conditioner 110 remotely via the Internet 150. Specifically, the control unit 131 receives the air conditioner information output by the air conditioner 110 and transmitted by the edge apparatus 120 via the Internet 150. The control unit 131 also transmits instruction information corresponding to the received air conditioner information, to the edge apparatus 120 via the Internet 150 either automatically or when an apparatus manager 162 inputs the instruction information. Thus, the server apparatus 130 functioning as the control unit 131 can control the air conditioner 110 remotely.

The control unit 131 transmits report information corresponding to the received air conditioner information, to the administrator terminal 140 via the Internet 150. The report information transmitted to the administrator terminal 140 includes, for example, information to report the start guidance of an emergency operation, information to report the success of setting information for an emergency operation, information to report beforehand the stopping of an emergency operation, information to report the stopping of an emergency operation, etc.

Further, in response to the transmission of the report information to the administrator terminal 140, the control unit 131 receives the possibility information for an emergency operation input by an air conditioner manager 163. A part of the above instruction information is transmitted to the edge apparatus 120 when the possibility information is received.

The administrator terminal 140 is a terminal operated by the air conditioner manager 163 (an example of a user; for example, a manager who manages a building equipped with the air conditioner 110) who manages the air conditioner 110. The administrator terminal 140 reports, to the air conditioner manager 163, the report information received from the server apparatus 130.

When the administrator terminal 140 reports the start guidance of the emergency operation, the air conditioner manager 163 requests a worker 161 to perform maintenance work and inputs the possibility information of the emergency operation. As a result, the possibility information is transmitted to the server apparatus 130 via the Internet 150.

<Hardware Configuration of Edge Apparatus and Server Apparatus>

Next, the hardware configuration of the edge apparatus 120 and the server apparatus 130 will be described.

(1) Hardware Configuration of the Edge Apparatus 120

Figure 2A:
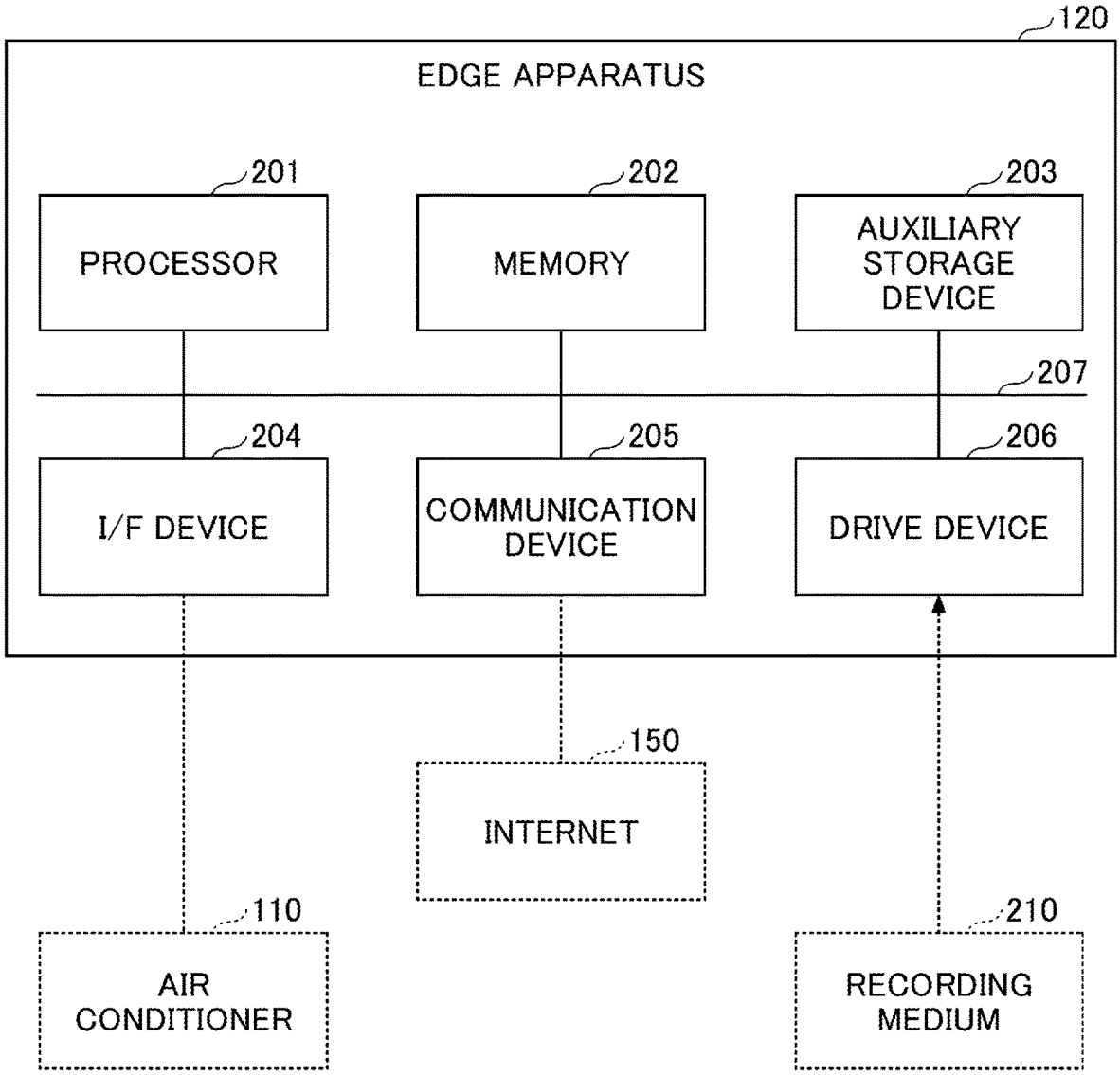
FIG. 2A illustrates an example of the hardware configuration of an edge apparatus.

FIG. 2A illustrates an example of the hardware configuration of the edge apparatus. As illustrated in FIG. 2A, the edge apparatus 120 includes a processor 201, a memory 202, an auxiliary storage device 203, an I/F (Interface) device 204, a communication device 205, and a drive device 206. Each piece of hardware of the edge apparatus 120 is connected to each other via a bus 207.

The processor 201 includes various computing devices such as a CPU (Central Processing Unit) and a GPU (Graphics Processing Unit). The processor 201 reads various programs (programs for implementing the above functions of the edge apparatus 120) into the memory 202 and executes the programs.

The memory 202 includes a main storage device such as a ROM (Read Only Memory), a RAM (Random Access Memory), etc. The processor 201 and the memory 202 form what is referred to as a computer.

The auxiliary storage device 203 stores various programs and various kinds of data used when various programs are executed by the processor 201.

The I/F device 204 is a device for the edge apparatus 120 to communicate with the air conditioner 110 via an exclusive-use communication line.

The communication device 205 is a device for the edge apparatus 120 to communicate with another apparatus (the server apparatus 130) via the Internet 150.

The drive device 206 is a device for setting a recording medium 210. The recording medium 210 here includes media for recording information optically, electrically, or magnetically, such as a CD-ROM, a flexible disk, a magneto-optical disk, etc. Further, the recording medium 210 may include a semiconductor memory, etc., for electrically recording information, such as a ROM, a flash memory, etc.

Various programs installed in the auxiliary storage device 203 are installed, for example, when the distributed recording medium 210 is set in the drive device 206 and various programs recorded in the recording medium 210 are read by the drive device 206. Alternatively, various programs installed in the auxiliary storage device 203 may be installed by being downloaded from the Internet 150 via the communication device 205.

(2) Hardware Configuration of the Server Apparatus 130

Figure 2B:
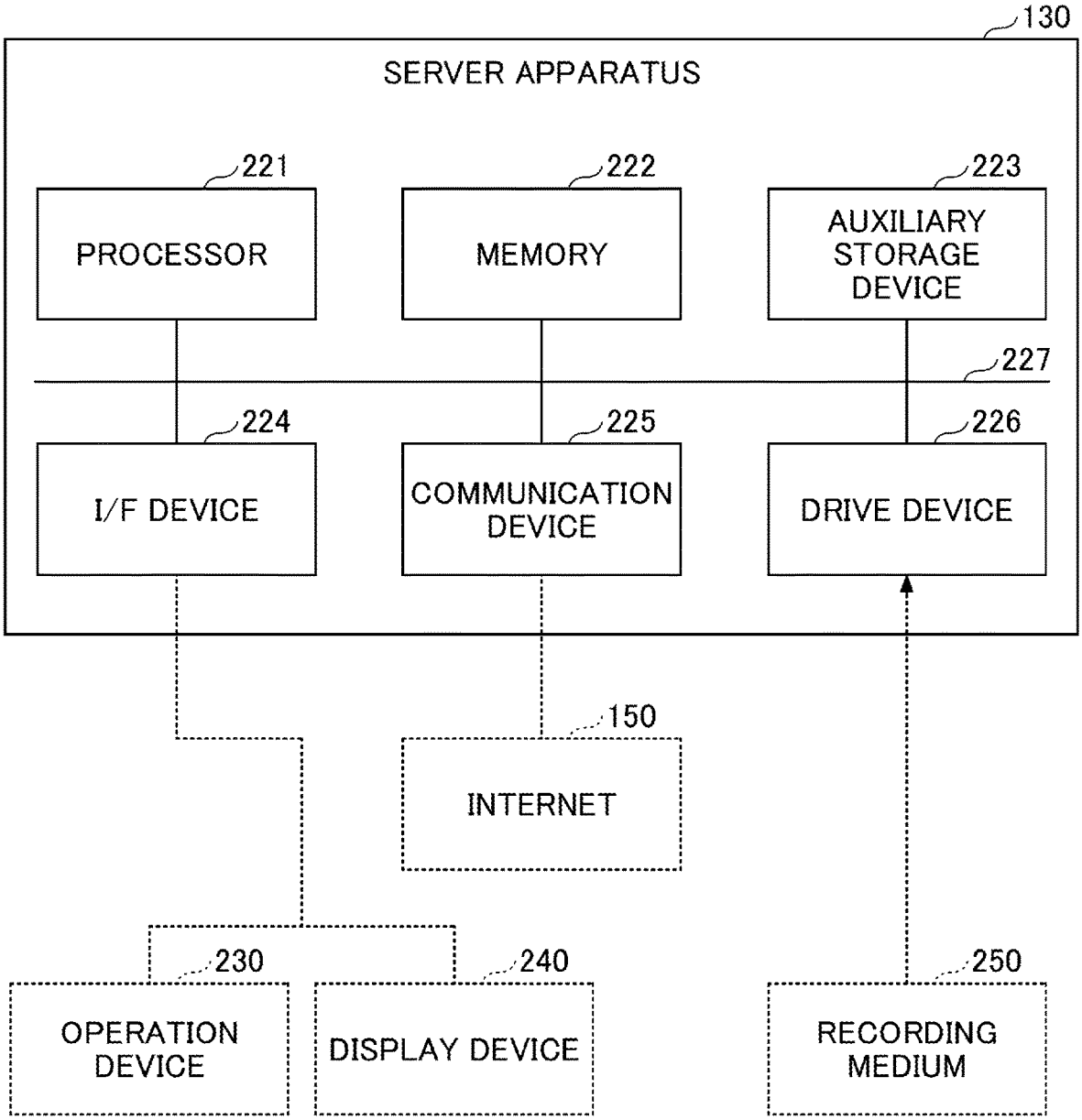
FIG. 2B illustrates an example of the hardware configuration of a server apparatus.

FIG. 2B illustrates an example of the hardware configuration of the server apparatus. The hardware configuration of the server apparatus 130 is almost the same as that of the edge apparatus 120, and, therefore, the differences from the hardware configuration of the edge apparatus 120 will be mainly described here.

A processor 221 reads various programs (for example, control programs, etc.) into a memory 222 and executes the programs.

The memory 222 includes a main storage device such as a ROM (Read Only Memory) and a RAM (Random Access Memory). The processor 221 and the memory 222 form what is referred to as a computer, and when the processor 221 executes various programs read on the memory 222, the computer implements the control unit 131.

An auxiliary storage device 223 stores various programs and various kinds of data (for example, emergency operation history to be described later) used when various programs are executed by the processor 221.

An I/F device 224 is a connection device connecting an operation device 230 and a display device 240, which are examples of external devices, and the server apparatus 130. The I/F device 224 receives an operation on the server apparatus 130 made by the apparatus manager 162 via the operation device 230. Further, the I/F device 224 displays the results of various kinds of processing by the server apparatus 130, to the apparatus manager 162 via the display device 240.

A communication device 225 is a communication device for communicating with other apparatuses (the edge apparatus 120, the administrator terminal 140, etc.) via the Internet 150.

<Flow of Air Conditioner Control Process>

Figure 3:
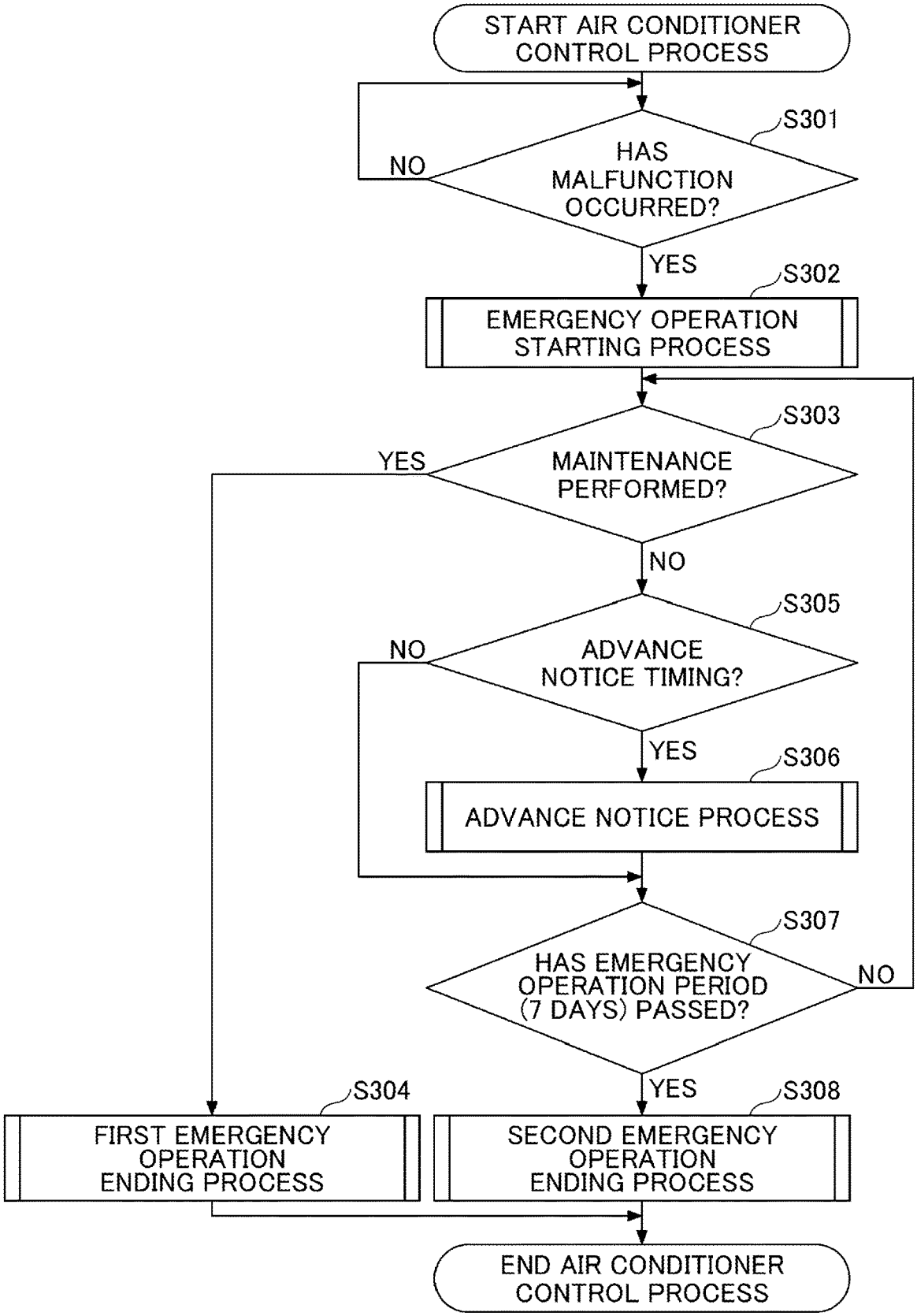
FIG. 3 illustrates an example of a flow chart illustrating the flow of an air conditioner control process by the air conditioner control system.

Next, the flow of an air conditioner control process by the air conditioner control system 100 will be described. FIG. 3 is an example of a flow chart illustrating the flow of an air conditioner control process by the air conditioner control system.

In step S301, the air conditioner 110 determines whether a malfunction has occurred. When it is determined in step S301 that no malfunction has occurred (NO in step S301), the air conditioner waits until a malfunction occurs.

On the other hand, when it is determined in step S301 that a malfunction has occurred (YES in step S301), the air conditioner advances to step S302.

In step S302, the air conditioner 110, the edge apparatus 120, the server apparatus 130, and the administrator terminal 140 perform an emergency operation starting process. Details of the emergency operation starting process will be described later with reference to FIG. 4.

In step S303, the air conditioner 110 determines whether maintenance has been performed by the worker 161. When it is determined in step S303 that maintenance has been performed (YES in step S303), the process proceeds to step S304.

In step S304, the air conditioner 110, the edge apparatus 120, the server apparatus 130, and the administrator terminal 140 perform a first emergency operation ending process. Details of the first emergency operation ending process will be described later with reference to FIG. 5.

On the other hand, when it is determined in step S303 that no maintenance has been performed (NO in step S303), the process proceeds to step S305.

In step S305, the server apparatus 130 determines whether the timing of an advance notice has been reached. An advance notice means to report an advance notice that the emergency operation will automatically stop to the administrator terminal 140, before the emergency operation is stopped automatically upon continuing the emergency operation that has started in step S302 for a predetermined period of time (when a predetermined emergency operation period has passed). In the present embodiment, the emergency operation period is assumed to be seven days, and the timing of the advance notice is assumed to be the day before the last day of the emergency operation period. That is, in the present embodiment, the advance notice is assumed to be given on the sixth day after the start of the emergency operation.

When it is determined in step S305 that the timing of the advance notice has been reached (YES in step S305), the process proceeds to step S306. In step S306, the server apparatus 130 and the administrator terminal 140 perform an advance notice process and then proceed to step S307. Details of the advance notice process will be described later with reference to FIG. 6.

On the other hand, when it is determined in step S305 that an advance notice timing has not been reached or that an advance notice timing has already passed (NO in step S305), the process proceeds directly to step S307.

In step S307, the server apparatus 130 determines whether the emergency operation has continued for a predetermined period of time (whether a predetermined emergency operation period has passed). When it is determined in step S307 that the emergency operation has not continued for a predetermined period of time (a predetermined emergency operation period has not passed) (NO in step S307), the process returns to step S303.

On the other hand, when it is determined in step S307 that the emergency operation has continued for a predetermined period of time (a predetermined emergency operation period has passed) (YES in step S307), the process proceeds to step S308.

In step S308, the air conditioner 110, the edge apparatus 120, the server apparatus 130, and the administrator terminal 140 perform a second emergency operation ending process. Details of the second emergency operation ending process will be described later with reference to FIG. 6.

Thus, in the air conditioner control system 100, when the emergency operation is started, the time keeping of the emergency operation period is started, and when the emergency operation period has passed, the emergency operation is automatically stopped (the second emergency operation ending process in step S308). With this, according to the air conditioner control system 100, it is possible to avoid a situation where an emergency operation continues for more than a predetermined period, and the risk of failure of the air conditioner during an emergency operation can be reduced.

Further, in the air conditioner control system 100, the emergency operation is stopped when maintenance is performed by the worker 161 during the emergency operation period (the first emergency operation ending process in steps S303 and S304). With this, according to the air conditioner control system 100, the emergency operation can be ended without waiting for the emergency operation period to pass, and the risk of failure of the air conditioner during emergency operation can be reduced.

<Flow of Emergency Operation Starting Process>

Figure 4:
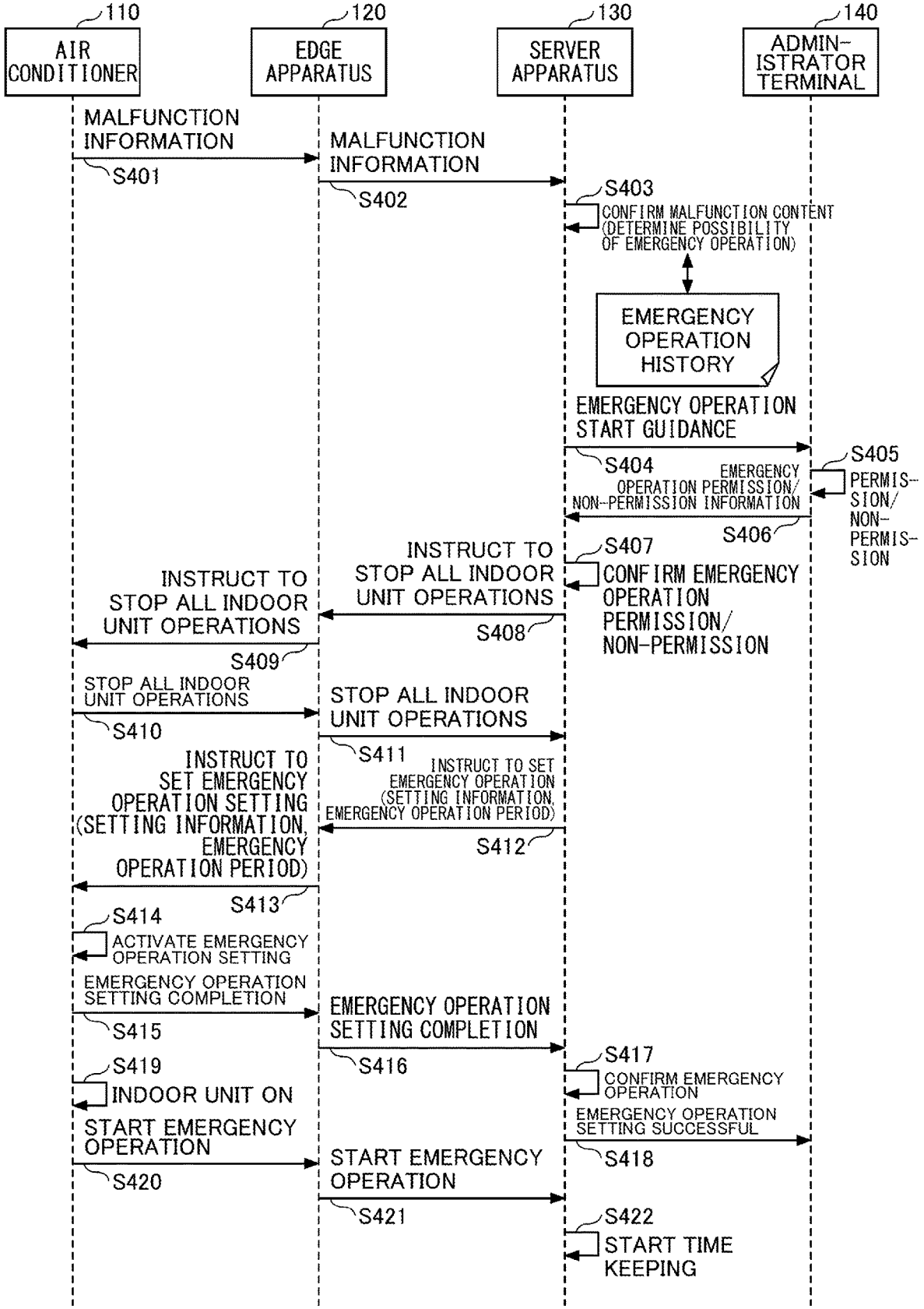
FIG. 4 illustrates an example of a sequence chart illustrating the flow of emergency operation starting process.

Next, details of the emergency operation starting process (step S302 in FIG. 3) will be described. FIG. 4 is an example of a sequence diagram illustrating the flow of the emergency operation starting process. As described above, when it is determined that a malfunction has occurred in the air conditioner 110 (YES in step S301 of FIG. 3), the emergency operation starting process illustrated in FIG. 4 is performed.

In step S401, the air conditioner 110 transmits the malfunction information to the edge apparatus 120.

In step S402, the edge apparatus 120 transmits the malfunction information transmitted from the air conditioner 110 to the server apparatus 130 via the Internet 150.

In step S403, the control unit 131 of the server apparatus 130 confirms the content of the malfunction information transmitted from the edge apparatus 120 and determines whether an emergency operation is possible. Further, when it is determined that an emergency operation is possible, the control unit 131 of the server apparatus 130 refers to the past emergency operation history and determines whether a predetermined condition is satisfied.

Note that the control unit 131 of the server apparatus 130 determines that a predetermined condition is satisfied when, for example, the same air conditioner 110 has been subjected to an emergency operation within a predetermined period (for example, 30 days) due to the same malfunction information (malfunction code). On the other hand, the control unit 131 of the server apparatus 130 determines that a predetermined condition is not satisfied when, for example, the same air conditioner 110 has not been subjected to an emergency operation within a predetermined period (for example, 30 days) due to the same malfunction information (malfunction code).

When it is determined that the predetermined condition is not satisfied, the control unit 131 of the server apparatus 130 transmits information to report, to the administrator terminal 140, the emergency operation start guidance in step S404. Accordingly, the administrator terminal 140 reports, to the air conditioner manager 163, the emergency operation start guidance.

In step S405, in response to the report of the emergency operation start guidance, the air conditioner manager 163 requests the worker 161 to perform maintenance work, and inputs an instruction to permit or to not permit an emergency operation to the administrator terminal 140.

In step S406, the administrator terminal 140 transmits emergency operation permission/non-permission information to the server apparatus 130.

In step S407, the control unit 131 of the server apparatus 130 confirms whether the content of the malfunction information has changed and, based on the emergency operation permission/non-permission information, confirms whether the air conditioner manager 163 has permitted or not permitted an emergency operation.

If the content of the malfunction information has not changed and the air conditioner manager 163 has permitted an emergency operation, in step S408, the control unit 131 of the server apparatus 130 transmits information instructing to stop operation of all indoor units to the edge apparatus 120 via the Internet 150.

In step S409, the edge apparatus 120 receives information from the server apparatus 130 instructing to stop operation of all indoor units and transmits the information to the air conditioner 110. When the information instructing to stop operation of all indoor units is transmitted, the air conditioner 110 stops the operation of all indoor units (the indoor units 111, 112). This stops the operation of all indoor units (however, the cooling/heating mode settings, the temperature settings, etc., set for all indoor units are retained).

In step S410, the air conditioner 110 transmits information indicating the state of the air conditioner 110 during an emergency operation (that the operation of all indoor units has stopped) to the edge apparatus 120.

In step S411, the edge apparatus 120 transmits information indicating the state of the air conditioner 110 during the emergency operation (that the operation of all indoor units has stopped) to the server apparatus 130 via the Internet 150.

In step S412, the control unit 131 of the server apparatus 130 transmits information indicating the setting of the emergency operation to the edge apparatus 120 via the Internet 150.

The information that the control unit 131 of the server apparatus 130 transmits to the edge apparatus 120 to instruct the setting of the emergency operation includes the emergency operation setting information (for example, a setting that prohibits the operation of an outdoor unit 113 and masks malfunction information about the outdoor unit 113). Further, the information instructing the setting of the emergency operation may include information related to the emergency operation period (in the present embodiment, seven days).

In step S413, the edge apparatus 120 transmits information instructing the setting of the emergency operation to the air conditioner 110.

In step S414, the air conditioner 110 activates the emergency operation setting information included in the information instructing the setting of the emergency operation received from the edge apparatus 120.

When the emergency operation setting information is activated, in step S415, the air conditioner 110 transmits information (report of completion of setting) indicating the state of the air conditioner 110 during the emergency operation (that an emergency operation setting has been completed) to the edge apparatus 120.

In step S416, the edge apparatus 120 transmits information indicating the state of the air conditioner 110 during an emergency operation (that an emergency operation setting has been completed) to the server apparatus 130 via the Internet 150.

In step S417, the control unit 131 of the server apparatus 130 confirms that the emergency operation setting has been completed in the air conditioner 110.

In step S418, the control unit 131 of the server apparatus 130 transmits, to the administrator terminal 140, information reporting the success of setting information for an emergency operation in the air conditioner 110. With this, the administrator terminal 140 reports to the air conditioner manager 163 that the setting information for an emergency operation has been set in the air conditioner 110.

In step S419, the worker 161 or the air conditioner manager 163 instructs the start of an emergency operation based on the setting information for an emergency operation by operating the remote control of the indoor unit. With this, the air conditioner 110 starts an emergency operation.

When the emergency operation is started, in step S420, the air conditioner 110 transmits, to the edge apparatus 120, information indicating the state of the air conditioner 110 during the emergency operation (that the emergency operation has been started).

In step S421, the edge apparatus 120 receives, from the air conditioner 110, information indicating the state of the air conditioner 110 during the emergency operation (that the emergency operation has been started) and transmits the information to the server apparatus 130 via the Internet 150.

In step S422, the control unit 131 of the server apparatus 130 starts the time keeping of the emergency operation period.

Thus, in the air conditioner control system 100, information instructing the setting of an emergency operation is transmitted after the information instructing to stop operation of all indoor units (the indoor units 111, 112) of the air conditioner 110 is transmitted. Thus, according to the air conditioner control system 100, even if the setting information for an emergency operation is activated in the air conditioner 110, the emergency operation is not immediately started. Then, only when the worker 161 or the air conditioner manager 163 operates the remote controller of the indoor unit, the emergency operation is started.

As a result, according to the air conditioner control system 100, it is possible to avoid a situation where, for example, an emergency operation is inadvertently started when the worker 161 is in the vicinity of the air conditioner 110 on site and is about to start maintenance work. That is, according to the air conditioner control system 100, it is possible to ensure the safety of the worker 161 when starting an emergency operation.

In the example of FIG. 4, it is assumed that the server apparatus 130 starts the time keeping of the emergency operation period after receiving information indicating the state of the air conditioner 110 during the emergency operation (that the emergency operation has been started), but the timing to start the time keeping of the emergency operation period is not limited to this.

For example, the time keeping of the emergency operation period may be started at the timing when information reporting the emergency operation start guidance is transmitted to the manager terminal 140 (step S404) or at the timing when emergency operation permission/non-permission information is received from the manager terminal 140 (step S406).

<First Flow of Emergency Operation Ending Process>

Figure 5:
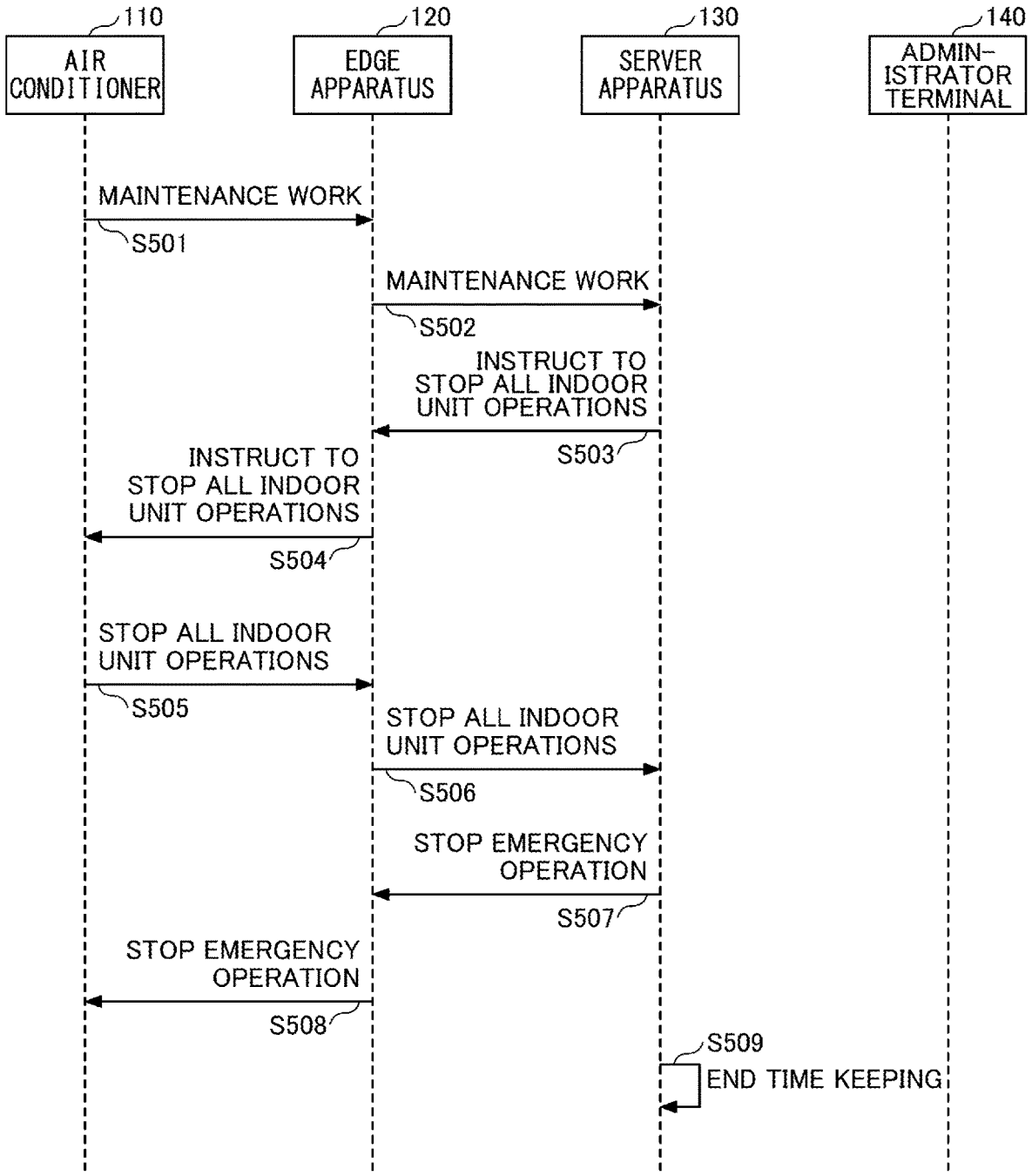
FIG. 5 illustrates an example of a sequence chart illustrating the flow of a first emergency operation ending process.

Next, details of the first emergency operation ending process (step S304 in FIG. 3) will be described. FIG. 5 is an example of a sequence diagram illustrating the flow of the first emergency operation ending process. As described above, in the air conditioner 110, when it is determined that maintenance work has been performed by the worker 161 (YES in step S303 of FIG. 3), the first emergency operation ending process illustrated in FIG. 5 is performed.

In step S501, the air conditioner 110 transmits, to the edge apparatus 120, information indicating that maintenance work has been performed by the worker 161.

In step S502, the edge apparatus 120 transmits information indicating that maintenance work has been performed, to the server apparatus 130 via the Internet 150.

In step S503, the control unit 131 of the server apparatus 130 transmits, to the edge apparatus 120 via the Internet 150, information instructing to stop operation of all indoor units in response to the transmission of information indicating that maintenance work has been performed from the edge apparatus 120.

In step S504, the edge apparatus 120 transmits information instructing to stop operation of all indoor units to the air conditioner 110. When the information instructing to stop operation of all indoor units is transmitted, the air conditioner 110 stops the operation of all indoor units (the indoor units 111, 112). Further, when the operation of all indoor units is stopped, the operation of the outdoor units 114 and 115 is also stopped.

In step S505, the air conditioner 110 transmits information indicating the state of the air conditioner 110 during the emergency operation (that the operation of all indoor units has stopped) to the edge apparatus 120.

In step S506, the edge apparatus 120 transmits information indicating that the operation of all indoor units has stopped to the server apparatus 130 via the Internet 150.

In step S507, the control unit 131 of the server apparatus 130 transmits information instructing to stop the emergency operation (for example, releasing the operation prohibition of the outdoor unit 113, and unmasking the malfunction information of the outdoor unit 113) to the edge apparatus 120 via the Internet 150.

In step S508, the edge apparatus 120 transmits information instructing the stopping of emergency operation to the air conditioner 110. This deactivates the setting information for an emergency operation in the air conditioner 110.

In step S509, the control unit 131 of the server apparatus 130 stops time keeping the emergency operation period. Accordingly, subsequently, even after the emergency operation period has passed, the information instructing to stop the emergency operation is not transmitted again from the server apparatus 130 to the air conditioner 110.

In this way, according to the air conditioner control system 100, the emergency operation can be ended without waiting for the emergency operation period to pass, and the risk of failure of the air conditioner during the emergency operation can be reduced.

<Flow of Advance Notice Process and Second Emergency Operation Ending Process>

Figure 6:
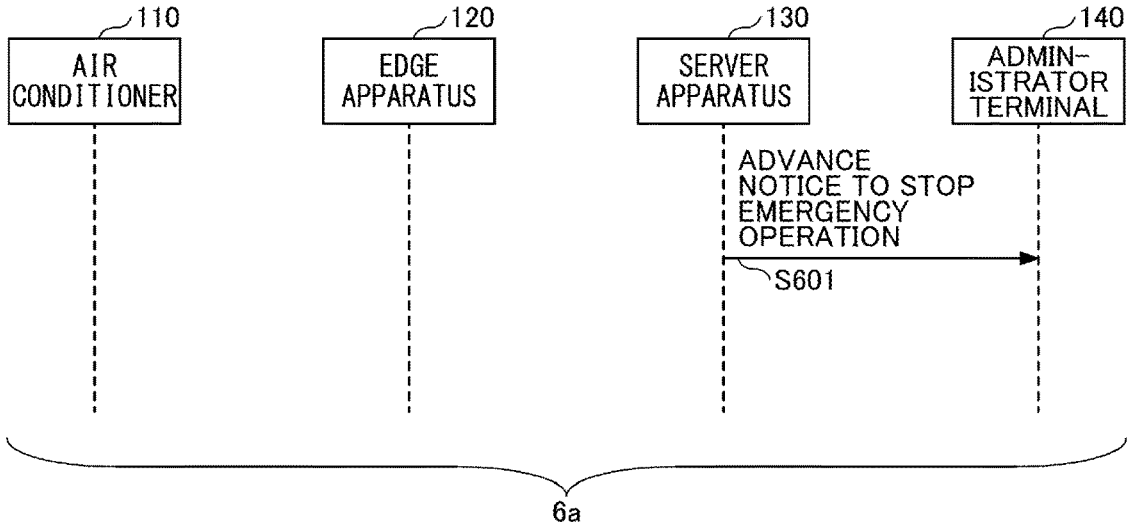
FIG. 6 is an example of a sequence diagram illustrating the flow of the advance notice process and a second emergency operation ending process.
Figure 6:
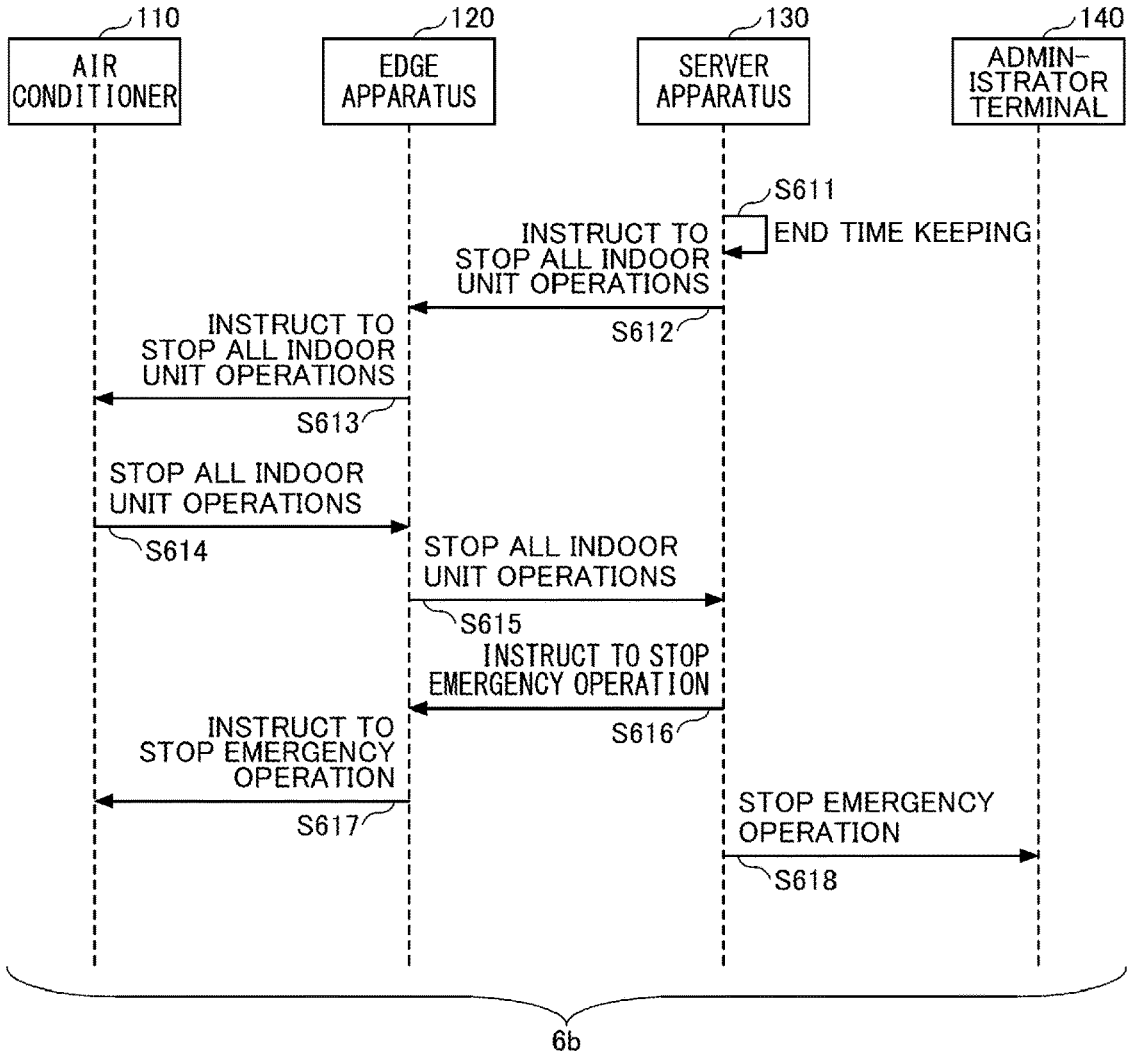

Next, details of the advance notice process (step S306 in FIG. 3) and the second emergency operation ending process (step S308 in FIG. 3) will be described. FIG. 6 illustrates examples of sequence diagrams of the flow of the advance notice process and the second emergency operation ending process. Among these, 6*a* of FIG. 6 illustrates an example of a sequence diagram of the flow of the advance notice process.

As described above, when the server apparatus 130 determines that the advance notice timing has been reached (YES in step S305 of FIG. 3), the advance notice process illustrated in 6*a* of FIG. 6 is performed.

In step S601, the control unit 131 of the server apparatus 130 transmits, to the administrator terminal 140, information to send an advance notice of stopping the emergency operation. Accordingly, the administrator terminal 140 sends, to the air conditioner manager 163, an advance notice of stopping the emergency operation, and the air conditioner manager 163 requests the worker 161 to perform maintenance work.

On the other hand, 6*b* in FIG. 6 illustrates an example of a sequence diagram of the flow of the second emergency operation ending process. As described above, in the server apparatus 130, when it is determined that the emergency operation period has passed (YES in step S307 in FIG. 3), the second emergency operation ending process illustrated in 6*b* in FIG. 6 is performed.

In step S611, the control unit 131 of the server apparatus 130 stops the time keeping of the emergency operation period.

In step S612, the control unit 131 of the server apparatus 130 transmits information instructing the stopping of operation of all indoor units to the edge apparatus 120 via the Internet 150.

In step S613, the edge apparatus 120 transmits information instructing to stop operation of all indoor units to the air conditioner 110. When the information instructing to stop operation of all indoor units is transmitted, the air conditioner 110 stops the operation of all indoor units (the indoor units 111, 112). Further, when the operation of all indoor units is stopped, the operation of the outdoor units 114 and 115 is also stopped.

In step S614, the air conditioner 110 transmits information indicating the state of the air conditioner 110 during the emergency operation (that the operation of all indoor units has stopped) to the edge apparatus 120.

In step S615, the edge apparatus 120 transmits information indicating that the operation of all indoor units has stopped to the server apparatus 130 via the Internet 150.

In step S616, the control unit 131 of the server apparatus 130 transmits information instructing to stop the emergency operation (for example, releasing the operation prohibition of the outdoor unit 113, and unmasking the malfunction information of the outdoor unit 113) to the edge apparatus 120 via the Internet 150.

In step S617, the edge apparatus 120 transmits information instructing to stop the emergency operation to the air conditioner 110. This deactivates the setting information for the emergency operation in the air conditioner 110.

Further, in step S618, the control unit 131 of the server apparatus 130 transmits information reporting the stopping of the emergency operation to the administrator terminal 140. With this, the administrator terminal 140 reports the stopping of the emergency operation to the air conditioner manager 163, and the air conditioner manager 163 recognizes that the emergency operation has stopped when the emergency operation period has passed.

In the case of the second emergency operation ending process, the setting information for the emergency operation is deactivated in step S617, which unmasks the malfunction information of the outdoor unit 113, and therefore, the malfunction information is transmitted to the server apparatus 130 again.

However, the malfunction information transmitted at this time has the same content (same air conditioner, same fault code) as the malfunction information transmitted before the emergency operation had started. Therefore, the server apparatus 130 determines that the predetermined condition is satisfied and does not transmit the information to report the start guidance of the emergency operation to the administrator terminal 140 again.

SUMMARY

As is clear from the above description, the air conditioner control system 100 transmits information instructing the air conditioner to set the emergency operation when malfunction information is received from the air conditioner, and transmits information instructing the air conditioner to stop the emergency operation when the emergency operation period has passed. Further, the air conditioner control system 100 transmits information instructing the air conditioner to stop the emergency operation when information indicating that maintenance work has been performed is received from the air conditioner during the emergency operation period.

Thus, the air conditioner control system 100 automatically stops the emergency operation when the emergency operation period has passed. With this, according to the air conditioner control system 100, it is possible to avoid a situation where the emergency operation continues for more than the predetermined period, and the risk of failure of the air conditioner during emergency operation can be reduced.

Further, according to the air conditioner control system 100, the emergency operation can be ended without waiting for the emergency operation period to pass, and the risk of failure of the air conditioner during emergency operation can be reduced.

When the air conditioner control system 100 receives malfunction information from the air conditioner, the air conditioner control system 100 transmits information instructing the air conditioner to set an emergency operation after transmitting information instructing to stop the operation of all indoor units of the air conditioner.

Thus, according to the air conditioner control system 100, even if the setting information for an emergency operation is activated in the air conditioner, the emergency operation is not started immediately, but the emergency operation starts only when the remote controller of the indoor unit is operated.

As a result, according to the air conditioner control system 100, it is possible to avoid a situation where emergency operation is started inadvertently, for example, when the worker is around the air conditioner and is about to start maintenance work. That is, according to the air conditioner control system 100, it is possible to ensure the safety of the worker when the emergency operation is started.

Second Embodiment

In the first embodiment described above, the control unit 131 of the server apparatus 130 refers to the past emergency operation history and determines that a predetermined condition is satisfied when an emergency operation caused at the same air conditioner and by the same malfunction code had been performed.

However, the method of determining whether a predetermined condition is satisfied is not limited to this, and for example, even if the malfunction code is different, it may be determined that a predetermined condition is satisfied when an emergency operation caused at the same air conditioner has been performed.

In the above first embodiment, the control unit 131 of the server apparatus 130 transmits information instructing the air conditioner to stop operation of all indoor units of the air conditioner and then transmits information instructing the air conditioner to set an emergency operation. However, the information instructing the air conditioner to stop operation of all indoor units may be transmitted mainly by the edge apparatus 120.

For example, the server apparatus 130 may transmit information instructing the setting of emergency operation to the edge apparatus 120 without transmitting information instructing the air conditioner to stop operation of all indoor units. Then, the edge apparatus 120 may be configured to transmit information instructing to stop operation of all indoor units, by being triggered by receiving information instructing the setting of the emergency operation, and subsequently transmit information instructing the setting of the emergency operation.

In the first embodiment, the edge apparatus 120 is described as having a function of transmitting the air conditioner information output by the air conditioner 110 to the server apparatus 130 and transmitting the instruction information transmitted by the server apparatus 130 to the air conditioner 110. However, the function of the edge apparatus 120 is not limited to this, and for example, the edge apparatus 120 may have a function of part or all of the control unit 131 of the server apparatus 130.

That is, the function of the control unit 131 of the server apparatus 130 may be implemented by the processor 221 of the server apparatus 130 or by the processor 201 of the edge apparatus 120. Alternatively, the function may be implemented by cooperation between the processor 221 of the server apparatus 130 and the processor 201 of the edge apparatus 120.

As a case in which the edge apparatus 120 implements some of the functions of the control unit 131 of the server apparatus 130, for example, the edge apparatus 120 performs the time keeping of the emergency operation period when the information instructing to set the emergency operation includes information related to the emergency operation period.

As described above, it will be understood that various changes in form and details are possible without departing from the purpose and scope of the claims.

The present application is based upon and claims priority to Japanese Patent Application No. 2020-199820 filed on Dec. 1, 2020, the entire contents of which are incorporated herein by reference.

REFERENCE SIGNS LIST

100: air conditioner control system
111, 112: indoor unit
113 to 115: outdoor unit
120: edge apparatus
130: server apparatus
131: control unit
140: administrator terminal

The invention claimed is:

1. An air conditioner control system comprising:
an air conditioner;
a server apparatus communicably connected to the air conditioner; and
a control unit configured to transmit setting information for an emergency operation to the air conditioner after instructing to stop operation of all indoor units of the air conditioner, in response to receiving a report indicating malfunction from the air conditioner,
wherein the control unit is configured to:
start the emergency operation based on the setting information; and
stop the emergency operation, in response to receiving maintenance information from the air conditioner during the emergency operation.

2. The air conditioner control system according to claim 1,
wherein the control unit is configured to report that the setting information for the emergency operation has been successfully set, in response to receiving a setting completion report from the air conditioner.

3. The air conditioner control system according to claim 1, wherein
the air conditioner includes at least a plurality of outdoor units, and
the emergency operation is performed by an outdoor unit other than an outdoor unit in which the malfunction has occurred among the plurality of outdoor units.

4. A server apparatus communicably connected to an air conditioner, the server apparatus comprising:
a control unit configured to transmit setting information for an emergency operation to the air conditioner after instructing to stop operation of all indoor units of the air conditioner, in response to receiving a report indicating malfunction from the air conditioner,
wherein the control unit is configured to:
start the emergency operation based on the setting information; and
stop the emergency operation, in response to receiving maintenance information from the air conditioner during the emergency operation.

5. An air conditioner control method performed in an air conditioner control system including an air conditioner and a server apparatus communicably connected to the air conditioner, the air conditioner control method comprising:
a control step of transmitting setting information for an emergency operation to the air conditioner after instructing to stop operation of all indoor units of the air conditioner, in response to receiving a report indicating malfunction from the air conditioner, the method further comprising:
starting the emergency operation based on the setting information; and
stopping the emergency operation, in response to receiving maintenance information from the air conditioner during the emergency operation.

* * * * *